United States Patent [19]

Ojembarrena et al.

[11] 4,283,035

[45] Aug. 11, 1981

[54] ARRANGEMENT FOR SUPPORTING A CURTAIN HOLDING ROD

[76] Inventors: Luciano G. Ojembarrena, Rodriguez Marin, 69; Francisco I. Robles, Cuevas de Almanzora, 46, both of Madrid, Spain

[21] Appl. No.: 80,018

[22] Filed: Sep. 28, 1979

[30] Foreign Application Priority Data

Apr. 23, 1979 [ES] Spain ..... 242.834[U]

[51] Int. Cl.[3] ..... A47H 1/10

[52] U.S. Cl. ..... 248/263; 248/265

[58] Field of Search ..... 248/262, 263, 269, 265, 248/267, 268, 270, 254, 255, 256, 257, 258, 259, 260, 271, 272

[56] References Cited

U.S. PATENT DOCUMENTS

| | | | |
|---|---|---|---|
| 758,419 | 4/1904 | Cooke | 248/259 |
| 1,015,879 | 1/1912 | Escher | 248/256 |
| 1,751,517 | 3/1930 | Hansen | 248/269 |
| 1,892,603 | 12/1932 | Beehler | 248/254 |
| 2,481,802 | 9/1949 | Wadkins | 248/254 |
| 3,157,225 | 11/1964 | Freydberg et al. | 248/262 X |
| 3,704,851 | 12/1972 | Cormier | 248/265 |

FOREIGN PATENT DOCUMENTS

| | | | |
|---|---|---|---|
| 504252 | 4/1939 | United Kingdom | 248/262 |

*Primary Examiner*—J. Franklin Foss

*Attorney, Agent, or Firm*—Michael J. Striker

[57] ABSTRACT

An arrangement for supporting a rod for holding a curtain or the like has two elongated U-shaped elements which are movable one inside the other and have lateral portions provided with openings which are open in a direction transverse to the direction of elongation. The elements are movable relative to one another between a first position in which the openings are offset from one another so that a rod can be inserted into the latter, and a second position in which the openings at least partially overlap one another so as to form together a closed contour and to retain the inserted rod.

14 Claims, 5 Drawing Figures

ARRANGEMENT FOR SUPPORTING A CURTAIN HOLDING ROD

BACKGROUND OF THE INVENTION

The present invention relates to an arrangement for supporting a rod for holding curtains and the like, or to a curtain rod bracket.

Curtain rod brackets or supporting arrangements are known in the art and widely utilized. There are a great variety of curtain rod brackets of different types and models, in dependence upon their locations (ceilings, wall) types of curtains or decoration, and other factors. This increases cost and complicates the mounting of the curtain rod brackets.

SUMMARY OF THE INVENTION

Accordingly, it is an object of the present invention to provide an arrangement for supporting a curtain rod or the like, which avoids the disadvantages of the prior art.

More particularly, it is an object of the present invention to provide an arrangement for supporting a curtain holding rod, which has a simple construction, is easy to mount, can be utilized for various curtain holding rods, and at the same time reliably holds the latter.

In keeping with these objects and with others which will become apparent hereinafter, one feature of the present invention resides, briefly stated, in an arrangement which has two elongated U-shaped elements movable in one another and provided with transversely open openings in lateral portions of the elements, the openings being arranged so that in a first relative position of the elements the openings are offset relative to one another and a curtain holding rod can be inserted into the openings, whereas in a second relative position the openings overlap one another so that the inserted curtain holding rod is retained in the openings.

Where the arrangement is constructed in accordance with the present invention, it has a simple construction, is easy to mount, matches to a great variety of curtain holding rods and reliably supports and retains the latter.

Another feature of the present invention is that the arrangement may be provided with a flat holding member connected to a portion of one of the elements, such as the outer element, and attachable to a support structure. The flat holding member may extend normal to this portion or portions of the outer element.

Still another feature of the present invention is that openings may have circular sections overlapping each other in the second position, and straight sections communicating with the circular sections and being open in the transverse direction. The circular sections may have a diameter corresponding to that of the curtain holding rod.

The straight sections may have longitudinal widths corresponding to the diameters of the circular sections. The straight sections of the openings of one of the elements may be inclined in a direction which is opposite to the direction in which the straight sections of the openings of the other element are inclined. Thus, the above-mentioned overlapping of the openings in the second position is provided.

A further feature of the present invention is that means may be provided for arresting the movable elements with one another. This means may be formed by a longitudinal slot in a bottom portion of one of the elements, and a clamping member associated with a bottom portion of the other element so that the clamping member moves in the slot during relative movement of the elements and fixes the latter with one another. The clamping member may be formed as a screw located in a circular orifice of the other element.

Still a further feature of the present invention is that each lateral portion of the outer element may be provided with a recess located at its end opposite to the holding portion and respectively cooperating with the openings of the inner element in the above-mentioned first and second positions so as to allow insertion of the curtain holding rod into or to provide its retention in the openings, respectively.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

An arrangement for supporting a rod for holding curtains and the like has an elongated outer U-shaped element 1 and an elongated inner U-shaped element 2 movably received in the outer element 1. Each of the elements 1 and 2 has two lateral portions which are connected with one another by a bottom portion so as to form together the U-shaped element.

Figure 5:
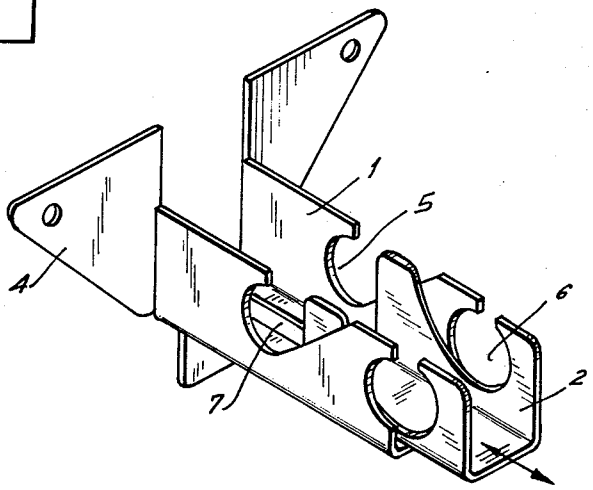
FIG. 5 is a perspective view of the inventive arrangement.
Figure 3:
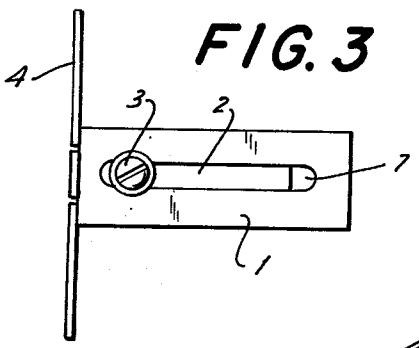
FIG. 3 is a view from below of the arrangement shown in FIG. 1.
Figure 4:
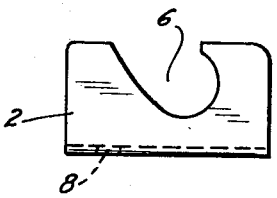
FIG. 4 is a view showing an inner U-shaped element of the inventive arrangement.

One of the elements, for example the outer element 1, is provided with means for mounting the arrangement on a wall or a ceiling. This means is formed as a flat member 4 which is connected to the above-mentioned portions of the outer element 1. The flat member 4 may extend normal to the portions of the outer element 1 and be of one piece therewith. As can be seen from FIG. 5, the flat member 4 may be composed of one lower section connected to the bottom portion, and two upper sections connected to the lateral portions of the outer element 1. It is to be understood that the flat member 4 may be associated not with the outer element 1 but with the inner element 2. The flat member 4 is provided with holes for mounting screws or the like, so that the flat member 4 and thereby the outer element 1 can be attached by the screws to the wall or ceiling.

Each lateral portion of the outer element 1 is provided with an opening 5 which is open upwardly in a direction transverse to the direction of elongation of the outer element 1. Each opening 5 has a circular section adjacent to the bottom portion of the outer element 1, and a substantially straight section extending upwardly from the circular section. More particularly, in the region near the bottom of the outer element 1, a wall bounding the circular section of the opening 5 merges into a tangentially extending wall bounding the substantially straight section. The tangentially extending wall is located at the side which is the farthest from the flat member 4. The width of the inlet of the straight section of each opening, measured over the upper edge of the outer member 1 in the direction of elongation of the latter, substantially corresponds to the diameter of the circular section of the opening.

Each lateral portion of the outer element 1 has, at its end spaced from the flat member 4, a recess 5' shaped as a circular arc. The center of the recess 5' is located on the same horizontal axis on which the center of the opening 5 is located. The recesses 5' are open laterally outwardly of the outer element 1 in the direction away from the flat member 4.

The inner element 2 has a shape substantially corresponding to the shape of the outer element 1. However, the inner element 2 is shorter than the latter and also has a somewhat smaller transverse dimension to be received into the interior of the outer element 1. Each lateral portion of the inner element 2 has an opening 6 which is similar to the openings 5 of the outer element 1 but is inverted. Whereas the circular sections of the openings 5 are located closer to the member 4 than the inlets of the straight sections, the circular sections of the openings 6 are located farther from the member 4 than the inlets of the straight sections of the same. In other words, the straight sections of the openings 5 and 6 are inclined in opposite directions.

The openings 5 and the recesses 5' of the outer element 1 are arranged in the lateral portions at identical locations in the longitudinal direction of the outer element 1. Similarly, the openings 6 are arranged in the lateral portions of the inner element 2 also at identical locations in the longitudinal direction of the inner element 2. It is to be understood that each lateral portion of the elements 1 and 2 may have several openings 5 and 6, respectively.

Means is further provided for arresting the inner element 2 with the outer element 1 in respective positions. This means includes an elongated slot 7 which is provided in the bottom portion of the outer element 1 and has a closed parallelogram-like contour. On the other hand, the bottom portion of the inner element 2 has a circular orifice 8 with a center coinciding with a longitudinal axis of the slot 7. A screw 3 extends through the orifice and engages in the slot 7 so that the screw 3 moves in the latter in the longitudinal direction during relative movement of the elements 1 and 2. Then, the screw 3 is tightened in the desired relative position of the elements 1 and 2 and thereby the latter will be firmly held together. In order to tighten the screw 3, a nut may be screwed on an inner end portion of the screw, or the orifice 8 of the inner element 2 may be provided with a thread. It is to be understood that the circular orifice 8 may be provided in the outer element 1, whereas elongated slot 7 may be provided in the inner element 2.

The arrangement in accordance with the present invention operates in the following manner.

Figure 1:
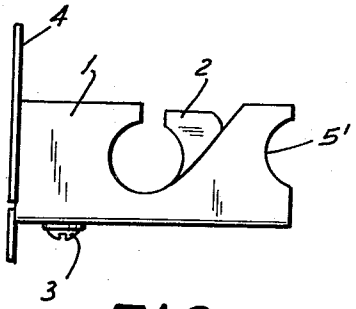
FIG. 1 shows an arrangement for supporting a curtain holding rod in accordance with the present invention, in an arresting position.
Figure 2:
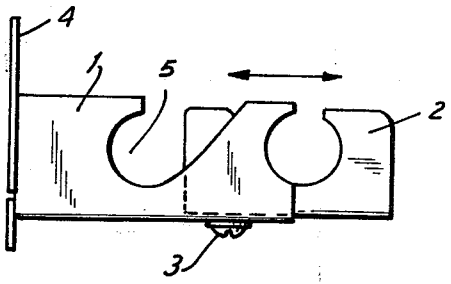
FIG. 2 shows the arrangement of FIG. 1 in another arresting position.

In order to support a rod for holding a curtain or the like, the inner element 2 is displaced in the longitudinal direction away from the member 6 so that the openings 6 of the inner element 2 do not overlap or substantially do not overlap the openings 5 of the outer element 1. Thereby, the open inlets of the openings 5 and 6 are not obstructed, and the curtain holding rod is inserted, for example, into the openings 5 of the outer element 1. Then the inner element 1 is displaced in the opposite direction to a position shown in FIG. 1 so that the openings 5 and 6 overlap each other and together form a substantially closed contour. The curtain holding rod is thereby firmly retained in the openings 5 and 6.

The curtain holding rod can also be inserted into the recesses 5' of the outer element 1. When thereafter the inner element 2 is displaced in the direction toward the member 4, the openings 6 of the inner element 2 partially overlap the recesses 5' of the outer element 1 and the curtain holding rod will be clamped therein at a location which is farther from the member 4 than the location of the openings 5. Therefore, the curtain holding rod may be supported at two different locations relative to the wall or ceiling. When several openings 5 are provided in each lateral portion of the outer element 1, the curtain holding rod may be supported at each of the several locations at different distances from the wall or ceiling.

It will be understood that each of the elements described above, or two or more together, may also find a useful application in other types of constructions differing from the types described above.

While the invention has been illustrated and described as embodied in an arrangement for supporting a curtain holding rod, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

That is claimed as new and desired to be protected by Letters Patent is set forth in the appended claims:

1. An arrangement for supporting a curtain holding rod or the like, comprising an elongated outer U-shaped element having two lateral portions and a bottom portion connecting said lateral portions with one another, said lateral portions each having at least one opening which is provided at identical locations in the direction of elongation and is open upwardly in a direction transverse to the direction of elongation; an elongated inner U-shaped element which is received in said outer element and has two further lateral portions and a further bottom portion connecting said further lateral portions with one another, said further lateral portions each having a further opening provided at identical locations in the direction of elongation and also open upwardly in a direction transverse to the direction of elongation, each of said openings having a circular section and a straight section communicating with one another, the straight sections of said first-mentioned openings of said outer element extending in a first direction which is inclined to the direction of elongation, whereas the straight sections of said further openings of said further openings of said inner element extend in a second direction which is also inclined to the direction of elongation and at the same time is opposite to said first direction, said inner and outer elements being slidably movable in direction of elongation thereof between a first position in which said first-mentioned openings of said outer element are offset relative to said further openings of said inner element so that a curtain holding rod can be inserted from above into at least said first-mentioned openings of said outer element or said further openings, and a second position in which said first-mentioned openings of said outer element and said further openings of said inner element at least partially overlap one another and together form a substantially closed receptacle so that a curtain holding rod inserted in the thus-formed receptacle is retained therein and supported from below by both elements; and means on at least one of said elements for mounting the same on a support structure in a substantially horizontal position.

2. An arrangement as defined in claim 1, wherein said mounting means includes three flat holding portions each connected with a respective one of said lateral and bottom portions of said one element and extending outwardly of the same, said holding portions being attachable to the support structure.

3. An arrangement as defined in claim 1, wherein said mounting means is a flat holding portion connected with at least one of the portions of said one element and attachable to the support structure.

4. An arrangement as defined in claim 3, wherein said holding portion extends normal to said one portion of said one element.

5. An arrangement as defined in claim 3, wherein said one element is formed by said outer element so that the latter can be mounted on the support structure with the aid of said holding portion.

6. An arrangement as defined in claim 1 for supporting a curtain holding rod of a predetermined diameter, wherein said circular sections of said openings have a diameter corresponding to the diameter of the curtain rod.

7. An arrangement as defined in claim 1, wherein each of said circular sections of said openings has a predetermined diameter, said straight sections of said openings having a width in the direction of elongation corresponding to said diameter of said circular openings.

8. An arrangement as defined in claim 1; and further comprising means for arresting said elements relative to one another.

9. An arrangement as defined in claim 8, wherein said arresting means includes a longitudinal slot provided in the bottom portion of one of said elements, and a clamping member associated with the bottom portion of the other of said elements and arranged to move in said slot during movement of said elements relative to one another and to fix said elements with one another.

10. An arrangement as defined in claim 9, wherein said slot is substantially parallelogram-shaped.

11. An arrangement as defined in claim 9, wherein said bottom portion of said other element has an orifice in which said clamping member is accommodated.

12. An arrangement as defined in claim 11, wherein said clamping member is a screw.

13. An arrangement as defined in claim 11, wherein said orifice is circular.

14. An arrangement as defined in claim 1, wherein each of said lateral portions of said outer element has a first end section associated with said mounting means and a second end section spaced from said first end section in the direction of elongation and having an end face, the second end section of each of said lateral portions of said outer element having a recess opening laterally at said end face, said inner and outer elements being slidably movable relative to one another to a third position in which said circular recesses of said outer member and said further openings of said inner member together form a substantially closed further receptacle so that a curtain rod inserted in the thus-formed further receptacle is retained therein.

* * * * *